US006705231B1

(12) United States Patent
Zacharin

(10) Patent No.: US 6,705,231 B1
(45) Date of Patent: Mar. 16, 2004

(54) SAFING AND ARMING DEVICE FOR ARTILLERY SUBMUNITIONS

(75) Inventor: Alexey Zacharin, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/957,713

(22) Filed: Sep. 17, 2001

Related U.S. Application Data

(60) Provisional application No. 60/251,349, filed on Dec. 4, 2000, and provisional application No. 60/122,258, filed on Feb. 24, 1999.

(51) Int. Cl.[7] ..... F42C 15/22; F42C 15/26

(52) U.S. Cl. ..... 102/231; 102/237; 102/244; 102/245

(58) Field of Search ..... 102/231, 235, 102/236, 237, 244, 245

(56) References Cited

U.S. PATENT DOCUMENTS 2,651,993 A * 9/1953 Berzof et al. ..... 102/232
3,603,259 A * 9/1971 Webb ..... 102/80
3,724,384 A * 4/1973 Donahue ..... 102/79
4,090,450 A * 5/1978 Nygards ..... 102/76
4,986,184 A * 1/1991 Kude ..... 102/256
5,048,419 A * 9/1991 Skowasch ..... 102/226

* cited by examiner

*Primary Examiner*—Michael J. Carone
*Assistant Examiner*—H. A. Blackner
(74) *Attorney, Agent, or Firm*—John F. Moran; Michael C. Sachs

(57) ABSTRACT

A safing and arming device is provided for a warhead or round which is to be launched by a rifled gun and which includes submunitions. A slider is disposed in a housing between a detonator and lead cup and is movable between a first, safe position wherein the slider acts as an interrupter and a second, armed position wherein an opening in the slider is in alignment with the detonator and lead cup. A setback sensor initially locks the slider in the safe position and then, responsive to a setback force produced at gun launch, unlocks the slider. An ejection sensor also initially locks the slider in the safe position and continues to lock the slider against movement to the armed position during a period between gun launch and exiting of the warhead from the gun. Responsive to the ejection force produced at exiting of the warhead from the gun, the ejection sensor unlocks the slider to enable movement thereof to the armed position.

8 Claims, 3 Drawing Sheets

SAFING AND ARMING DEVICE FOR ARTILLERY SUBMUNITIONS

This application claims benefit of Ser. No. 60/122,258 Feb. 28, 1999 and claims benefit of WO/251,349 Dec. 4, 2000.

U.S. GOVERNMENT INTEREST

The inventions described herein may be manufactured, used and licensed by or for the U.S. Government for U.S. Government purposes.

BACKGROUND OF THE INVENTION

1. Field of the Invention

The present invention relates to control devices for rounds shot by artillery and, more particularly, to a control device for automatically and sequentially making safe and then arming a fired round.

2. The Related Art

A need exists for safety controls during the firing of artillery submunitions which ensure that the detonator device (fuze) is safe during the initial firing stage but which also ensures that the fuze is armed at the proper time. To the extent that the problem has been previously addressed, current proposals suffer shortcomings and are less than fully satisfactory. One application of such a control device is for SADARM submunitions developed by the U.S. Army but such a device could be applied to other artillery submunitions as well.

SUMMARY OF THE INVENTION

According to the invention, there is provided a safing and arming device for artillery submunitions which meets stringent safety and arming requirements. The device is compact and rugged as well as highly reliable and effective.

In accordance with a preferred embodiment of the invention, there is provided a safing and arming device for a warhead or round which is to be launched by a rifled gun and which includes at least one submunition, the device comprising:

a housing;

a detonator and lead cup disposed in spaced, aligned relation within said housing;

a slider disposed in the housing between the detonator and lead cup and including an opening therein, the slider being movable between a first, safe position wherein a portion of the slider spaced from the opening is disposed between the detonator and lead cup so as to act as an interrupter, and a second, armed position wherein the opening is in alignment with the detonator and lead cup and the device is thus armed;

a setback sensor disposed in the housing for initially locking the slider in the safe position and for, responsive to a setback force produced at gun launch, unlocking the slider; and an ejection sensor disposed in the housing for initially locking said slider in the safe position and for continuing to lock the slider against movement to the armed position during a period between gun launch and exiting of the warhead from the gun, and for, responsive to the ejection force produced at the exiting of the warhead from the gun, unlocking the slider to enable movement thereof to the armed position.

Preferably, the device further comprises a slider spring for biasing said slider into said safe position. The slider spring preferably comprises a coil spring producing an axially acting force against one end of the slider.

Preferably, the setback sensor comprises a setback sensor member received in a cavity in the housing and the device further comprises a setback spring for biasing the setback sensor member towards engagement with the slider. The setback spring preferably exerts a spring force orthogonal to an axially active spring force produced by the slider spring. The slider preferably includes an abutment portion having surface engaged by the setback sensor member in the safe position of the slider. The setback spring is compressed by the setback force so as to disengage the setback sensor member from the abutment portion and the abutment portion preferably includes a further surface engaged by the setback sensor member after movement of the slider to the armed position thereof so as to provide locking of the slider in the armed position by the setback sensor member.

Preferably, the slider includes a recess therein, the device further comprises an ejector spring received in the recess, and the ejection sensor comprises an ejection sensor member received in the recess and biased by the ejection spring against a portion of the housing in a locking position of the ejection sensor member. Advantageously, the ejection spring exerts a spring force orthogonal to an axially acting spring force produced by the slider spring. Preferably, a portion of the housing includes a stop member and the ejection member engages the stop member responsive to movement of the slider caused by the setback force to thereby limit the movement of the slider. The ejection spring is compressed by the ejection force to disengage the ejection sensor member from the stop member and to unlock the slider to permit movement of the slider to the armed position. The movement of the slider to the armed position causes positioning of the ejection sensor member on the other side of the stop member and a diminishing of the ejection force enables the ejection spring to bias the ejection sensor member in a locking position thereby locking the slider in the armed position.

Further features and advantages of the present invention will be set forth in, or apparent from, the detailed description of preferred embodiments thereof which follows.

DESCRIPTION OF THE PREFERRED EMBODIMENTS

Figure 1:
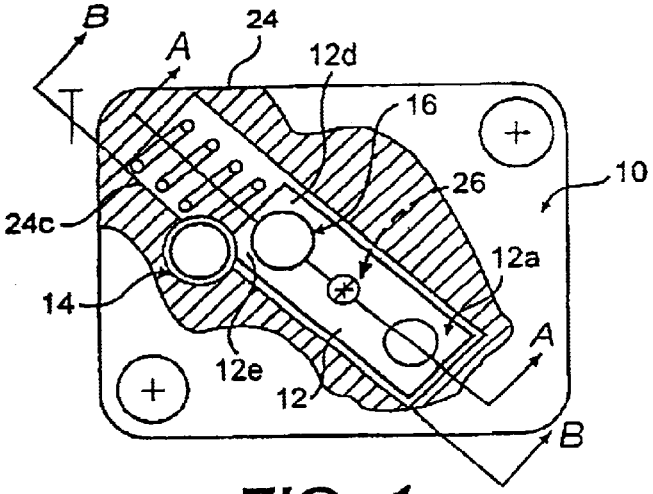
FIG. 1 is a top plan view, partially broken away, of a safing and arming device constructed in accordance with a preferred embodiment of the invention showing the device in the safe position.
Figure 2A:
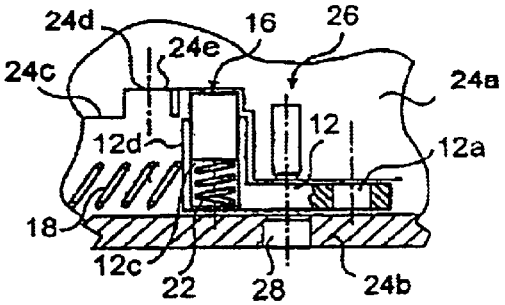
FIGS. 2(*a*) and 2(*b*) are cross-sectional views taken generally along lines A—A and B—B, respectively.
Figure 2B:
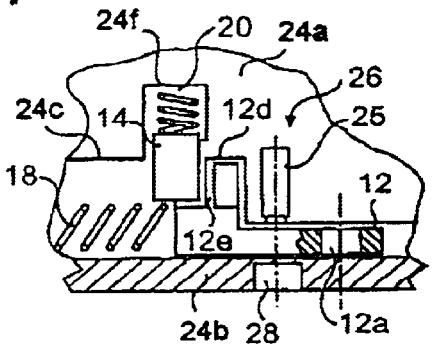

Referring first to FIG. 1 and FIGS. 2(*a*) and 2(*b*), the safing and arming device or unit of the invention, which is generally denoted 10, includes the following major components: a slider 12, a setback sensor 14, an ejection sensor 16, and three spring, a slider spring 18, a setback spring 20 and an ejection spring 22.

The device or unit 10 also includes a housing 24 including an upper portion 24*a* which houses a conventional detonator 26 and lower portion 24*b* which supports a conventional lead cup 28 in alignment with detonator 26. Slide 12 includes an opening 12*a* therein which, in the armed position of slide 12 described below, provides a passage between detonator 26 and lead cup 28.

Before describing these figures and the other figures of the drawings in more detail, a brief overall overview would be presented for purposes of orienting the discussion which follows. As indicated above, slider 12 acts as an interrupter between the detonator 26 and the lead cup 28 and has a safe position (shown in FIGS. 1, 2(*a*) and 2(*b*) among others) and an armed position shown in other drawing figures. Slider 12 is held in the safe position by the setback sensor 14, the ejection sensor 16, and the slider spring 18. As described in more detail below, the ejector sensor 16 is located within the slider 12. The setback sensor 14 reacts to the gun launch setback force and unlocks the slider 12. The ejection sensor reacts to the force produced by the ejection of the submunition from the warhead or round and unlocks the slider. The springs 18, 20 and 22 function in a manner described below to keep the slider 12 in the safe and locked position.

Figure 3:
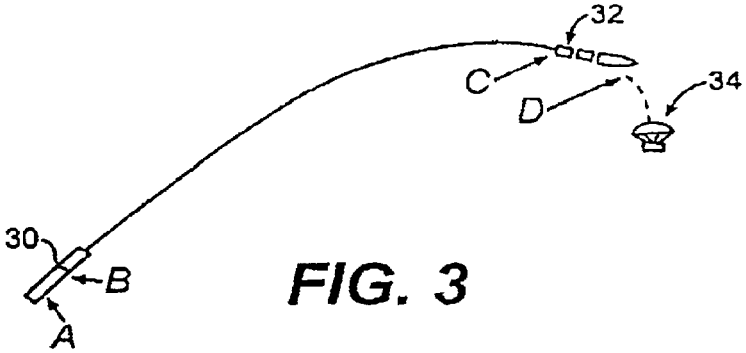
FIG. 3 is a schematic representation of the sequence of events occurring during the launch of a warhead which has been launched by a rifled gun and which incorporates the safing and arming device of the invention.
Figure 4A:
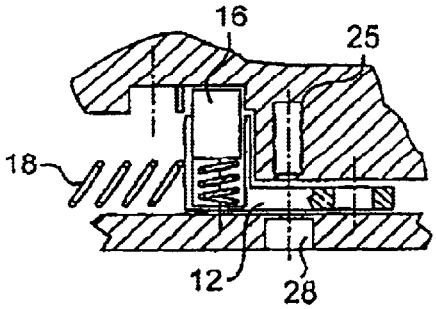
FIGS. 4(*a*) and 4(*b*) are views similar to FIGS. 2(*a*) and 2(*b*) showing the setback mode or position of the device.
Figure 4B:
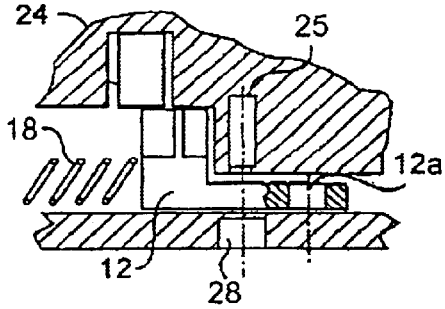

The basic operation can also be better understood by considering FIG. 3, which is a schematic representation of the operational sequence. The rifled gun is represented at 30, the warhead and subparts at 32 and the raid deploy submunition at 34. In FIG. 3, "A" generally indicates the point in the sequence at which the setback sensor 14, in response to the gun launch setback force, unlocks slider 12. "B" indicates the point at which the slider 12 moves to the ejector sensor lock position described below wherein the fuze 25 is in the safe mode. "C" indicates the point at which the ejection sensor 16 unlocks the slider 12 so that the fuze 25 is armed. Finally, "D" indicates the point at which the ejection sensor 16 locks the slider 12 in the armed position.

Referring again to FIGS. 1, 2(*a*) and 2(*b*), as illustrated, slide spring 18 is a coil spring which is captured within a cavity 24*c* in housing 24 and which bears on one end of slider 12 so as to bias slider 12 into the safe position shown.

As indicated above, and is best seen in FIG. 2(*a*), ejector sensor 16 is received in an opening 12*c* in an upright end portion 12*d* of slider 12 and is biased by ejector spring 22 into a cavity 24*d* in upper housing 24*a* against an upper end wall defined by the cavity, 24*d*. A stop 24*e* projects into cavity 24*d* as shown and performs a function described below.

As shown in FIG. 2(*b*), setback sensor 14 is received in a further cavity 24*f* in housing 24, and engages and is biased against one side of a further part 12*e* of the upright end portion 12*d* of slider 12.

Figure 5A:
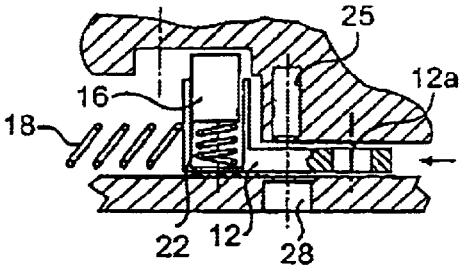
FIGS. 5(*a*) and 5(*b*) are further views similar to FIGS. 2(*a*) and 2(*b*) showing the setback spin mode or position of the device.
Figure 5B:
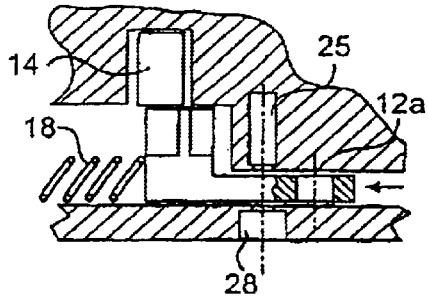

Referring to FIGS. 5(*a*) and 5(*b*), the setback/spin mode or position is shown. As the spin within the gun 30 (FIG. 3) decreases, the centrifugal force on slider 12 will be sufficient to move slider 12 against slider spring 18. The slider 12 will move a short distance (0.050 in an exemplary embodiment) to a point where the ejection sensor 16 engages stop 24*e*. In this position, slider 12 locks the setback sensor 14 in the unlocked position. However, the slider 12 remains in the detonation safe position and this situation is indicated at B in FIG. 3. After the gun tube exit, the spin force keeps the slider 12 pressed against the slider spring 18 and the ejection sensor 16 keeps the slider 12 in the safe position.

Figure 6A:
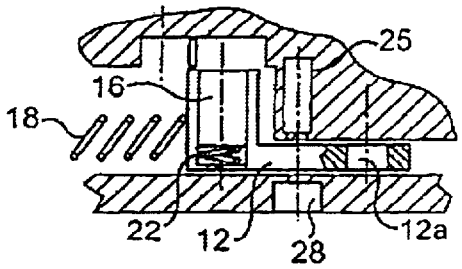
FIGS. 6(*a*) and 6(*b*) are further views similar to FIGS. 2(*a*) and 2(*b*) showing ignition mode or position of the device.
Figure 6B:
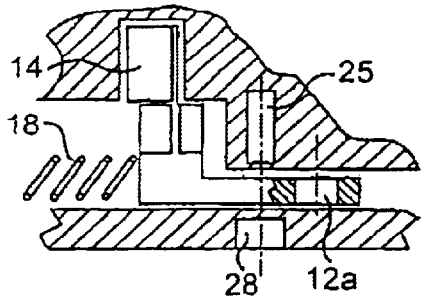

FIGS. 6(*a*) and 6(*b*) illustrate the ejection mode or position. Upon the ejection of the submunition from the warhead as shown generally at 32 in FIG. 3, the resultant ejection force compresses the ejection sensor 16 against the ejection spring 22 and fully unlocks slider 12.

Figure 7A:
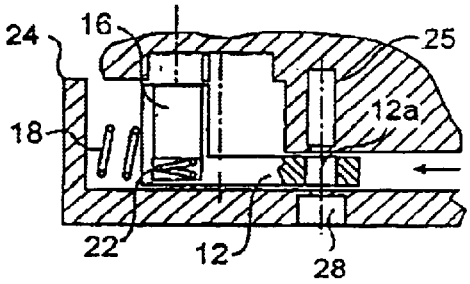
FIGS. 7(*a*) and 7(*b*) are further views similar to FIGS. 2(*a*) and 2(*b*) showing the ejection/spin mode or position of the device.
Figure 7B:
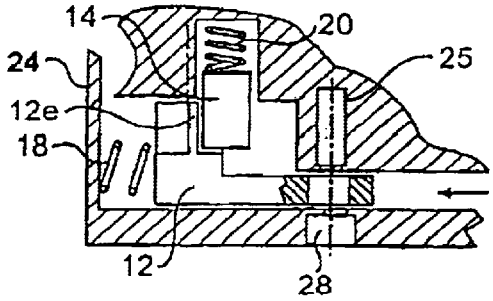

Referring to FIGS. 7(*a*) and 7(*b*), the ejection/spin mode or position is shown. Upon unlocking of the slider 12 from the ejection sensor 16, the spin present will force the slider 12 into the armed position, compressing the slider spring 18. This situation is indicated at C in FIG. 3. As soon as the slider 12 clears the setback sensor 14, the ejection force will move the setback sensor 14, together with the setback spring 20, into a further slider lock position wherein sensor 14 engages the other side of the further part 12*e* of upright end portion 12*d* of slider 12, as shown.

Figure 8A:
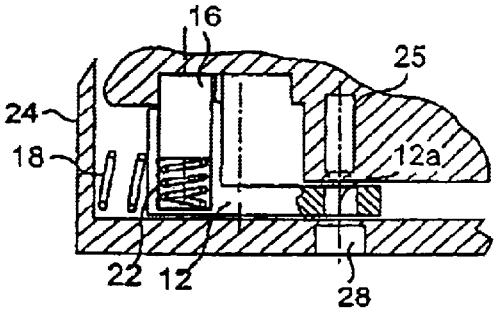
FIGS. 8(*a*) and 8(*b*) are further views similar to FIGS. 2(*a*) and 2(*b*) showing spin mode or position of the device.
Figure 8B:
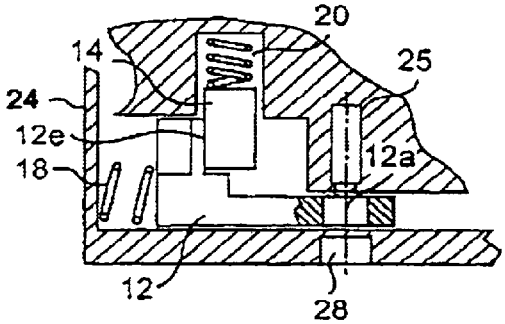

The final, spin position or mode is shown in FIGS. 8(*a*) and 8(*b*). As soon as the ejection force dissipates, the ejection spring 22 forces the ejection sensor 16 into the slider lock position. At this point, no forcing function will unlock the slider 12 since both of the locks now provided act in the opposing direction to any unlocking movement. Thus, the device is fully armed and cannot be unlocked.

It will be noted that the device 10 is quite small, with the length and width dimensions shown in FIG. 1 being 1.395 inches by 1.125 inches in a specific, non-limiting example.

Although the invention has been described above in relation to preferred embodiments thereof, it will be understood by those skilled in the art that variations and modifications can be effected in these preferred embodiments without departing from the scope and spirit of the invention.

What is claimed:

1. A safing and arming device for a warhead to be launched by a rifled gun and including at least one submunition, said safing and arming device comprising:

a housing;

a detonator and lead cup disposed in spaced, aligned relation within said housing;

a slider disposed in said housing between said detonator and said lead cup and including an opening therein, said slider being movable between a first, safe position wherein a portion of said slider spaced from said opening is disposed between said detonator and said lead cup and a second, armed position wherein said opening is in alignment with said detonator and said lead cup;

a setback sensor disposed in said housing for initially locking said slider in said safe position and for, responsive to a setback force produced at gun launch, unlocking said slider;

an ejection sensor disposed in said housing for initially locking said slider in said safe position and for continuing to lock said slider against movement to said armed position during a period between gun launch and exiting of the warhead from the gun, and for, responsive to the ejection force produced at exiting of the warhead from the gun, unlocking the slider to enable movement thereof to said armed position;

wherein said setback sensor comprises a setback sensor member received in a cavity in said housing and said safing and arming device further comprises a setback spring for biasing said setback sensor member towards engagement with said slider;

wherein said setback spring exerts a spring force orthogonal to an axially active spring force produced by a slider sing;

wherein said slider includes an abutment portion having surface engaged by said setback sensor member in said safe position of said slider; and wherein said setback spring is compressed by said setback force so as to disengage said setback sensor member from said abutment portion and wherein said abutment portion includes a further surface engaged by said setback sensor member after movement of the slider to the armed position thereof so as to provide locking of said slider in the armed position by said setback sensor member.

2. A safing and arming device according to claim 1 wherein said slider spring comprises a coil spring producing an axially acting force against one end of said slider.

3. A safing and arming device for a warhead to be launched by a rifled gun and including at least one submunition, said safing and arming device comprising:

a housing;

a detonator and lead cup disposed in spaced, aligned relation within said housing;

a slider disposed in said housing between said detonator and said lead cup and including an opening therein, said slider being movable between a first, safe position wherein a portion of said slider spaced from said opening is disposed between said detonator and said lead cup and a second, armed position wherein said opening is in alignment with said detonator and said lead cup;

a setback sensor disposed in said housing for initially locking said slider in said safe position and for, responsive to a setback force produced at gun launch, unlocking said slider;

an ejection sensor disposed in said housing for initially locking said slider in said safe position and for continuing to lock said slider against movement to said armed position during a period between gun launch and exiting of the warhead from the gun, and for, responsive to the ejection force produced at exiting of the warhead from the gun, unlocking the slider to enable movement thereof to said armed position;

wherein said slider includes a recess therein, said safing and arming device further comprises an elector spring received in said recess and said ejection sensor comprises an ejection sensor member received in said recess and biased by said ejector spring against a portion of said housing in a locking position of said ejection sensor member;

wherein said ejector spring exerts a spring force orthogonal to an axially acting spring force produced by said slider spring; and wherein a portion of said housing includes a stop member and said election sensor member engages said stop member responsive to movement of said slider caused by said setback force to thereby limit the movement of said slider.

4. A safing and arming device according to claim 3 wherein said ejector spring is compressed by said ejection force to disengage said ejection sensor member from said stop member and to unlock the slider to permit movement of the slider to said armed position and wherein said movement of the slider to said armed position causes positioning of the ejection sensor member on the other side of the stop member and a diminishing of said ejection force enables the ejector spring to bias the ejection sensor member in a locking position thereby locking said slider in said armed position.

5. A safing and arming device according to claim 4 wherein said setback sensor comprises a setback sensor member received in a cavity in said housing and said safing and arming device further comprises a setback spring for biasing said setback sensor member towards engagement with said slider.

6. safing and arming device according to claim 3 wherein said slider includes an abutment portion having surface engaged by said setback sensor member in said safe position of said slider.

7. A safing and arming device according to claim 6 wherein said setback spring is compressed by said setback force so as to disengage said setback sensor member from said abutment portion and wherein said abutment portion includes a further surface engaged by said setback sensor member after movement of the slider to the armed position thereof so as to provide locking of said slider in the armed position by said setback sensor member.

8. A safing and arming device for a warhead to be launched by a rifled gun and including at least one submunition, said safing and arming device comprising:

a housing;

a detonator and lead cup disposed in spaced, aligned relation within said housing;

a slider disposed in said housing between said detonator and said lead cup and including an opening therein, said slider being movable between a first, safe position wherein a portion of said slider spaced from said opening is disposed between said detonator and said lead cup and a second, armed position wherein said opening is in alignment with said detonator and said lead cup;

a setback sensor disposed in said housing for initially locking said slider in said safe position and for, responsive to a setback force produced at gun launch, unlocking said slider, said setback sensor comprising a setback sensor member received in a cavity in said housing and said safing and arming device further comprising a setback spring for biasing said setback sensor member towards engagement with said slider, said slider including an abutment portion having surface engaged by said setback sensor member in said safe position of said slider, and said setback spring being compressed by said setback force so as to disengage said setback sensor member from said abutment portion and said abutment portion further including a further surface engaged by said setback sensor member after movement of the slider to the armed position thereof so as to provide locking of said slider in the armed position by said setback sensor member; and an ejection sensor disposed in said housing for initially locking said slider in said safe position and for continuing to lock said slider against movement to said armed position during a period between gun launch and exiting of the warhead from the gun, and for, responsive to the ejection force produced at exiting of the warhead from the gun, unlocking the slider to enable movement thereof to said armed position, said slider including a recess therein, said safing and arming device further comprising an ejector spring received in said recess, and said ejection sensor comprising an ejection sensor member received in said recess and biased by said ejector spring against a portion of said housing in a locking position of said ejection sensor member, a portion of said housing including a stop member and said ejection sensor member engaging said stop member responsive to movement of said slider caused by said setback force to thereby limit the movement of said slider, said ejector spring being compressed by said ejection force to disengage said ejection sensor member from said stop member and to unlock the slider to permit movement of the slider to said armed position, said movement of the slider to said armed position causing positioning of the ejection sensor member on the other side of the stop member and diminishing of said ejection force enabling the ejector spring to bias the ejection sensor member in a locking position thereby locking said slider in said armed position.

* * * * *